US010290955B2

(12) United States Patent
Lee et al.

(10) Patent No.: US 10,290,955 B2
(45) Date of Patent: May 14, 2019

(54) TERMINAL FOR CONNECTOR FOR CONNECTING ELECTRIC WIRES WITHOUT PEELING

(71) Applicant: Young-Hwan Lee, Hanam (KR)

(72) Inventors: Young-Hwan Lee, Hanam (KR); Ok-Ja Yoo, Hanam (KR)

(73) Assignee: Young-Hwan Lee, Hanam (KR)

( * ) Notice: Subject to any disclaimer, the term of this patent is extended or adjusted under 35 U.S.C. 154(b) by 0 days.

(21) Appl. No.: 15/986,841

(22) Filed: May 23, 2018

(65) Prior Publication Data

US 2018/0342814 A1 Nov. 29, 2018

(30) Foreign Application Priority Data

May 29, 2017 (KR) ..... 10-2017-0065974

(51) Int. Cl.

| | |
|---|---|
| ***H01R 4/2456*** | (2018.01) |
| *H01R 4/242* | (2018.01) |
| *H01R 4/2437* | (2018.01) |
| *H01R 4/2441* | (2018.01) |
| *H01R 4/2425* | (2018.01) |

(52) U.S. Cl.

CPC ..... *H01R 4/2456* (2018.01); *H01R 4/242* (2013.01); *H01R 4/2425* (2013.01); *H01R 4/2437* (2013.01); *H01R 4/2441* (2013.01)

(58) Field of Classification Search

CPC .... H01R 4/242; H01R 4/2441; H01R 4/2437; H01R 4/2425; H01R 9/031

USPC ..... 439/402, 395

See application file for complete search history.

(56) References Cited

U.S. PATENT DOCUMENTS

| | | | | |
|---|---|---|---|---|
| 3,829,822 A * | 8/1974 | Geiser | H01R 4/2466 | 439/402 |
| 3,899,236 A * | 8/1975 | Santos | H01R 4/2433 | 439/402 |
| 3,936,128 A * | 2/1976 | D'Annessa | H01R 4/2454 | 439/399 |
| 4,084,877 A * | 4/1978 | Knickerbocker | H01R 4/2429 | 439/402 |
| 4,861,278 A * | 8/1989 | McBride | H01R 4/2416 | 439/395 |
| 4,891,018 A * | 1/1990 | Afflerbaugh | H01R 4/2433 | 439/402 |
| 5,727,965 A * | 3/1998 | Yagi | H01R 4/2454 | 439/402 |

(Continued)

*Primary Examiner* — Tho D Ta
*Assistant Examiner* — Marcus E Harcum

(57) ABSTRACT

Provided is a terminal for an electric wire connector including: a central erection piece configured to have cutting portions inclined downward and outward on both sides of its upper portion; a pair of outer erection pieces configured to be spaced apart at a desired interval on both sides of the central erection piece and have cutting portions that are inclined downward on the upper portion; a connector configured to connect the central erection piece and lower portions of the pair of outer erection pieces; an electrical wire entry portion configured to be a space through which the cutting portions face each other and be a path under which the electrical wire enters; and a core wire connector configured to be arranged on the lower portion communicating with the electric wire entry portion and be a space to connect the central erection piece and the outer erection piece.

3 Claims, 3 Drawing Sheets

(56) References Cited

U.S. PATENT DOCUMENTS

| | | | | |
|---|---|---|---|---|
| 8,025,522 | B2 * | 9/2011 | Freakes | H01F 5/04 439/402 |
| 2004/0097125 | A1 * | 5/2004 | Freakes | H01R 4/2425 439/402 |
| 2015/0311607 | A1 * | 10/2015 | Ding | H01R 4/2416 439/402 |

* cited by examiner

TERMINAL FOR CONNECTOR FOR CONNECTING ELECTRIC WIRES WITHOUT PEELING

CROSS REFERENCE TO RELATED APPLICATION

This application claims priority, under 35 U.S.C. § 119, from and the benefit of Korean Patent Application No. 10-2017-0065974, filed on May 29, 2017, which is hereby incorporated by reference for all purposes as if fully set forth herein.

BACKGROUND

Field

Exemplary embodiments of the present invention relate to a terminal for an electric wire connector without peeling.

Description of the Related Art

Generally, the method how to connect a certain electric wire to one or more other electric wires which are separated or how to connect an end of an electric wire to a desired device or the like is to peel the sheath of the electric wire and then arrange a plurality of exposed core wires by twisting them so as to connect them.

Here, in case of connecting different electric wires, they are blocked from contacts with other connection and external objects and external moisture by taping them with an insulating tape, but such a connecting work has a drawback that it is quite cumbersome and takes time.

Further, it has a problem that the resistance to an axial tension between the electric wires connected becomes reduced so that the connection between the electric wires is separated or deviated easily in the axial direction.

In order to solve such a problem, methods to connect the electric wires using a terminal having a blade to cut a sheath partially when mounting the electric wire on a connector without peeling the sheath of the electric wire are diversely suggested in the related art (A connector for electric wire connection without peeling).

For example, when reviewing the conventional terminal for electric wire connector, it has a structure that a cutting portion is arranged on an electric wire entry portion side in its upper portion and has a core wire connector in its lower portion, and the lower portions of a plurality of erection pieces which are spaced at regular intervals in the length direction are integrally connected.

However, in the conventional terminal (for example, Korea Registered Patent No. 10-0943203), an inclined angle of a cutting portion does not make a right angle to the central line of a core wire so that the cutting force cannot become maximized, and a core wire connector is of a primary erection structure so that the area connected with the core wire cannot become maximized. Further, the width area of an outer erection piece is not great so that it is pushed outward by the core wire. Therefore, the erection piece is opened so that its connection force becomes weak, increasing the contact resistance.

SUMMARY

Therefore, the present invention has been made in view of the above problems of the prior arts, and it is a primary object of the present invention to maximize the sheath cutting force by making the cutting portion the right angle to the central line of the core wire, thereby allowing the core wire to easily enter toward the core wire connector.

Further, another object of the present invention is to allow the central erection piece to have a recessed portion so that it wraps the core wire positioned in the core wire connector so as to maximize the connection area, making a good connection state between the core wire and the terminal.

In addition, a yet another object of the present invention is to provide a projection projected to the recessed portion in the outer erection piece opposite to the recessed portion so as to press the core wire to the recessed portion and at the same time the outer erection piece is not pushed outward by the core wire, thereby obtaining a stable connection between the core wire and the recessed portion, and preventing the outer erection piece from being deformed and damaged.

According to one aspect of the present invention, there is provided a terminal for an electric wire connector, including: a central erection piece configured to have cutting portions that are inclined downward and outward on both sides of its upper portion; a pair of outer erection pieces configured to be spaced apart at a desired interval on both sides of the central erection piece and have cutting portions that are inclined downward on the upper portion, symmetrically to the cutting portion of the central erection piece; a connector configured to connect the central erection piece and lower portions of the pair of outer erection pieces; an electrical wire entry portion configured to be a space through which the cutting portions face each other and be a path under which the electrical wire enters; and a core wire connector configured to be arranged on the lower portion communicating with the electric wire entry portion and be a space to connect the central erection piece and the outer erection piece when the core wire of the electric wire whose sheath is cut out enters therethrough.

That is, in order to solve the problem that the width area of the outer erection piece is not great so that the outer erection piece is pushed outward by the core wire and the erection piece is opened so that the connection force becomes weak thereby increasing the contact resistance, the present invention has a structure that the thickness of the outer erection piece becomes gradually great.

BRIEF DESCRIPTION OF THE DRAWINGS

The above and other objects and features of the present invention will become apparent from the following description of embodiments, given in conjunction with the accompanying drawings, in which:

FIGS. 4 and 5 are exemplary views of a case that a terminal 100 of the present invention is applied to an electric wire connector 200, wherein FIG. 4 is a schematic perspective view illustrating a state that a terminal is mounted on the connector and an electric wire is mounted on the cover, and FIG. 5 is a view illustrating a process to mount the electric wire on the terminal using the connector.

DETAILED DESCRIPTION OF EXEMPLARY EMBODIMENTS

Exemplary embodiments of the present disclosure will now be described in detail with reference to the drawings.

Hereinafter, the present invention will be described as below with reference to the accompanying drawings.

Figure 1:
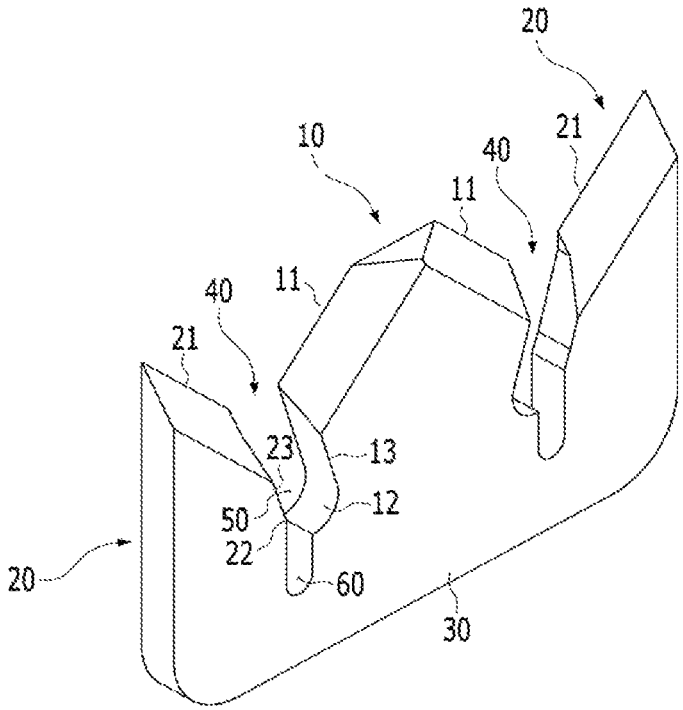
FIG. 1 illustrates a perspective view of a terminal for an electric wire connector according to an embodiment of the present invention.
Figure 2:
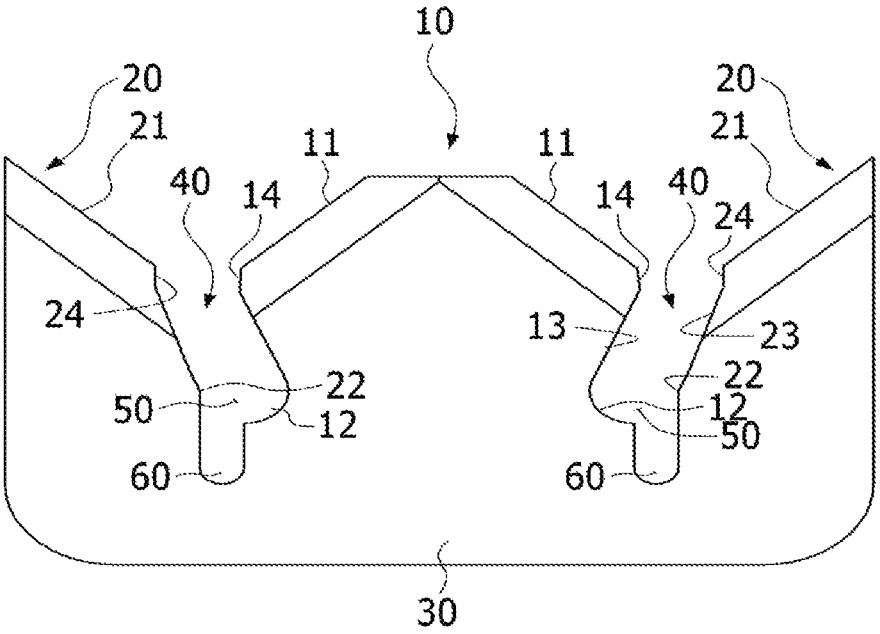
FIG. 2 illustrates a front view of the terminal for an electric wire connector according to an embodiment of the present invention.
Figure 3:
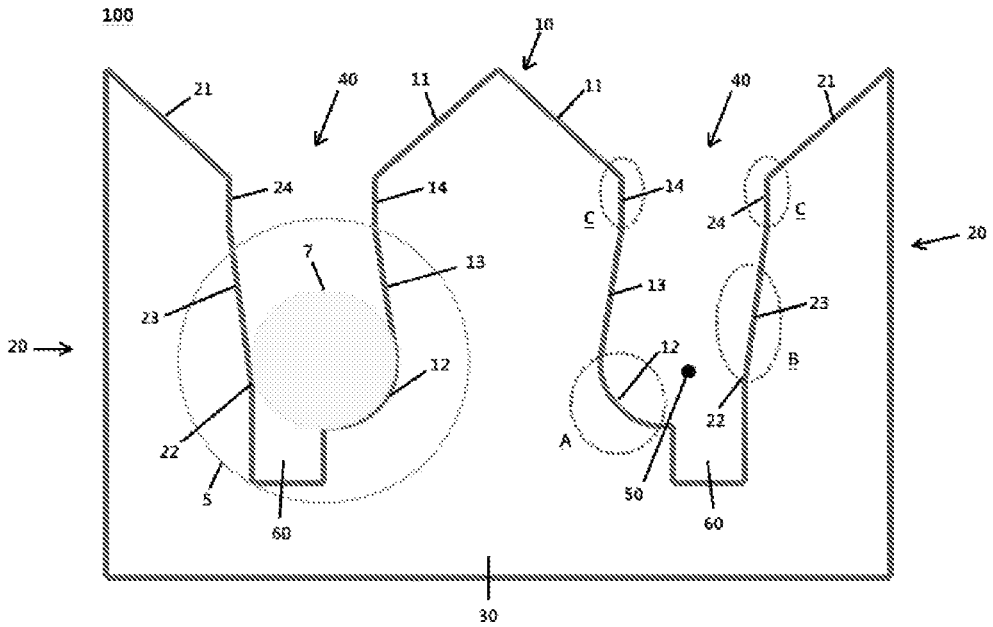
FIG. 3 is a front view illustrating a state that a core wire is connected to the terminal for an electric wire connector according to an embodiment of the present invention.

As illustrated in FIGS. 1 to 3, a terminal for an electric wire connector according to an embodiment of the present invention includes a central erection piece 10, a pair of outer erection pieces 20, and a connector 30.

The central erection piece 10 has a cutting portion 11 on both sides of the central erection piece 10, the cutting portion being narrow in its upper portion and wide in its lower portion.

The outer erection pieces 20 are erected on both sides of the central erection piece 10, spaced at a regular interval, and has a cutting portion 21 on its upper portion, which is inclined downward in the state that the cutting portion 21 symmetrically faces the cutting portion 11 of the central erection piece 10.

Further, the cutting portions 11 and 21 have a structure that becomes narrow in the width direction as they approach the upper direction so as to form a blade on the upper portion.

The connection portion 30 is formed in a rod shape which connects the central erection piece 10 and the lower portions of the pair of outer erection pieces 20.

Further, there is provided an electric wire entry portion 40 that is a space through which the cutting portions 11 and 21 face each other and at the same time a path where the sheath is cut out as the electric wire 5 enters downward.

In addition, there is provided a core wire connector 50 that is arranged on the lower portion communicating with the electric wire entry portion 40 and is a space to connect the core wire 7 to the central erection piece 10 and the outer erection pieces 20 each other when the core wire 7 (or, referred to as a copper wire) of the electric wire 5 whose sheath is cut out enters therethrough.

Here, the lower portions of the cutting portions 11 and 21 are inclined at 45° to the erection portions 14 and 24 so that they form a right angle with the central point of the electric wire 5 that enters into the electric wire entry portion 40, thereby maximizing the cutting force applied to the outer circumference of the electric wire 5.

Further, the central erection piece 10 has a recessed portion 12 that is rounded inward in a concave shape so that a portion corresponding to the core wire connector 50 connects to the core wire 7 in a shape to cover a portion of the outer circumference of the core wire 7 (see A portion of FIG. 3).

Here, the recessed portion 12 is rounded in a concave manner having a circle shape from 6 o'clock direction to 3 o'clock direction that is the lower center portion of the core wire 7 so as to cover the outer circumference of the core wire 7 and has an inclined portion 13 that is inclined upward at a point over 3 o'clock direction.

By providing the inclined portion 13 in this way, the core wire 7 enters along the inclined portion 13 and then can safely arrive on the recessed portion 12.

Further, provided on one side of the outer erection piece 20 corresponding to the recessed portion 12 is a projection 22 that is projected in the direction of the recessed portion 12 so as to push the core wire 7 in the direction of the recessed portion 12.

Here, the projection 22 is provided on the same line with the central line of the core wire 7 so that the pressure to the core wire 7 reaches the peak to be maximized.

Further, the outer erection piece 20 has a structure of an inclined portion 23 so that it is inclined downward toward the recessed portion 12 from the inner upper portion of the outer erection piece 20 to the projection 22, whereby the width of the projection 22 becomes wide as it reaches downward. Therefore, the outer erection piece is prevented from being pushed outward by the core wire 7 (see B portion of FIG. 3).

Further, erection portions 14 and 24 are provided between upper portions of the inclined portions 13 and 23 of the recessed portion 12 and the projection 22 and the lower portion of the corresponding cutting portions 11 and 22, which are erected parallel each other so that the sheath of the electric wire 51 is cut out and at the same time the core wire 7 stably enters between the erection pieces 10 and 20 (see C portion of the FIG. 3).

Here, it is desired that the gap between the inclined portions 13 and 23 and the gap between the erection portion 14 and 24 are the same as the diameter of the core wire 7 so that the core wire 7 entered between the erection pieces 10 and 20 keeps a connection state with the both erection pieces 10 and 20 from when the core wire 7 enters therebetween to when it safely arrives at the core wire connector 50. Accordingly, even when the core wire 7 does not reach the core wire connector 50, the connection can be obtained.

Further, the lower portion between the recessed portion 12 and the projection 22 has a space 60 where there is no connection with the core wire 7 in order to prevent the core wire 7 from being excited due to the tolerance to the core wire 7.

When reviewing the process in which the core wire is connected to the terminal of the present invention having such a configuration, the electric wire 5 to be connected is first descended from the electric wire entry portion 40.

Then, the sheath of the electric wire 5 is cut out by the both cutting portions 11 and 21 and at the same time the core wire 7 of the electric wire 5 is vertically descended between the erection portions 14 and 24 that have the same diameter.

Next, when the core wire 7 is descended along the inclined portions 13 and 23 that has the same diameter and reaches the core wire connector 50, and at the same time outer circumference portion of the core wire 7 in the right lower direction safely arrives at the recessed portion 12, a connection is finally obtained between the core wire 7 and the erection pieces 10 and 20.

In this manner, the terminal for the electric wire connector of the present invention maximizes the sheath cutting force by making the cutting portion inclined at the right angle to the central line of the core wire and making the core wire entry easy toward the core wire connector, resultantly enhancing the efficiency of the core wore connection work.

In addition, the central erection piece has a recessed portion to cover the core wire positioned in the core wire connector so as to maximize the connection area and to make the connection state between the core wire and the terminal well, providing reliability of the core wire connection state.

Further, the outer erection piece opposite to the recessed portion has a projection that is projected in the direction of the recessed portion in order to press the core wire to the recessed portion and at the same time not to be pushed by the core wire, thereby obtaining a stable connection between the core wire and the recessed portion, preventing the outer erection piece from being deformed and damaged, and saving costs due to the parts damage prevention.

Meanwhile, an example is illustrated in which the terminal 20 of the present invention is applied to the connector 200 for the electric wire connection.

Figure 4:
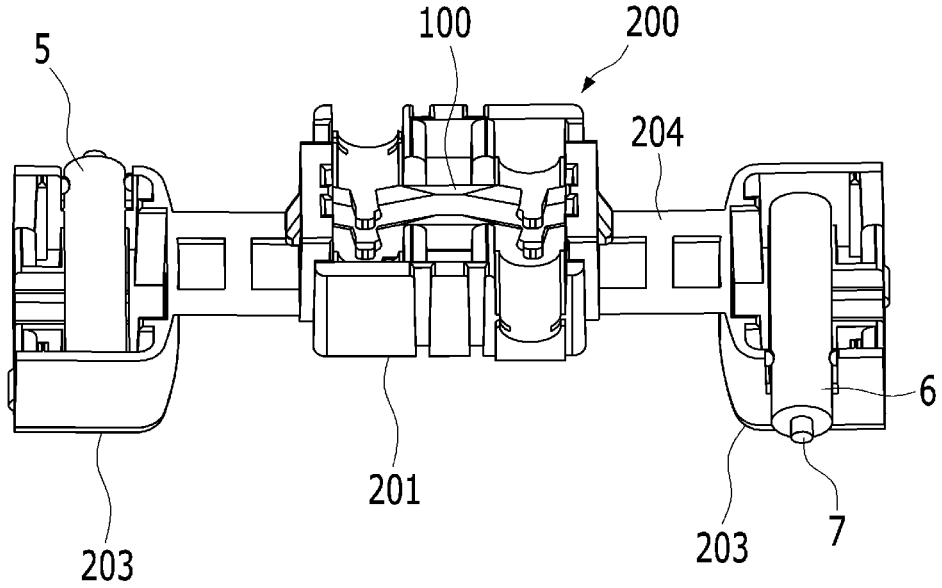
Figure 5:
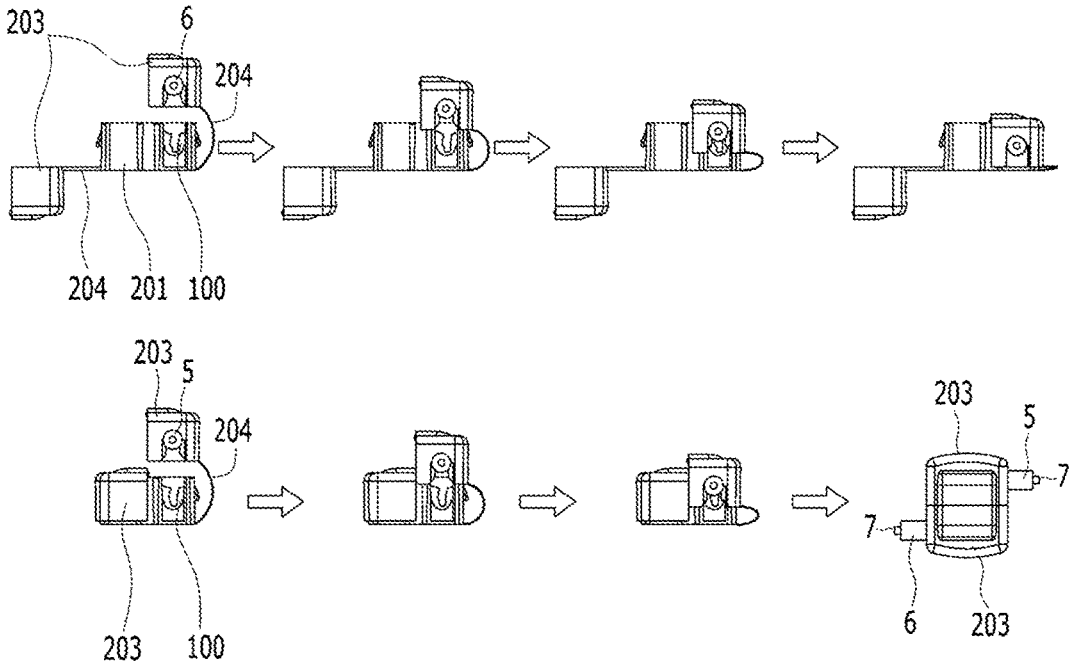

Referring to FIGS. 4 and 5, the connector 200 includes a main body 201, a terminal 20, and a pair of covers 203 to press the electric wires 5 and 6 that are laid on the terminal 20 and cover the upper portion of the main body 201. A bridge 204 connects the main body 201 and the cover 203 so that the main body 201 and the cover 203 become integrated, and can be removed after connection by cutting it out. FIG. 5 illustrates a process in which the electric wires 5 and 6 inserted into the pair of covers 203 is coupled with the terminal 20 in the opposite direction each other. Therefore, the core wires 7 of the two electric wires 5 and 6 can be electrically connected to each other without peeling them.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A terminal for an electric wire connector, comprising:

a central erection piece configured to have cutting portions that are inclined downward and outward on both sides of its upper portion;

a pair of outer erection pieces configured to be spaced apart at an interval on both sides of the central erection piece and have cutting portions that are inclined downward on an upper portion, symmetrically to the cutting portions of the central erection piece;

a connector configured to connect the central erection piece and lower portions of the pair of outer erection pieces;

an electrical wire entry portion configured to be a space through which the cutting portions face each other and be a path through which an electrical wire enters; and a core wire connector configured to be arranged on the lower portion communicating with the electric wire entry portion and be a space to connect the central erection piece and the outer erection piece when a core wire of the electric wire whose sheath is cut out enters therethrough, wherein the central erection piece has a recessed portion that is rounded inward in a concave shape so that a portion corresponding to the core wire connector connects to the core wire in a shape to cover a portion of an outer circumference of the core wire, and wherein one side of the outer erection piece corresponding to the recessed portion is projected in a direction of the recessed portion so as to provide a projection to push the core wire in the direction of the recessed portion.

2. The terminal according to claim 1, wherein erection portions are arranged between a plurality of inclined upper portions of the recessed portion and the projection and the lower portion of the corresponding cutting portion, the erection portions being erected parallel to each other so that the sheath of the electric wire is cut out at the same time the core wire enters between the erection pieces stably and vertically, and each cutting portion being inclined at 45° to each of the erection portions.

3. The terminal according to claim 1, wherein the projection is arranged on the same line with a central line of the core wire so that a pressure to the core wire reaches a peak.

* * * * *